United States Patent [19]

Vermeulen

[11] Patent Number: 4,878,446

[45] Date of Patent: Nov. 7, 1989

[54] METHOD FOR THE FORMING AND THE DEPOSITION IN A SELECTED PLACE OF A BULK

[75] Inventor: Jan Vermeulen, Delden, Netherlands

[73] Assignee: Nicolon B.V., Netherlands

[21] Appl. No.: 224,919

[22] PCT Filed: Nov. 11, 1987

[86] PCT No.: PCT/NL87/00031

§ 371 Date: Jun. 27, 1988

§ 102(e) Date: Jun. 27, 1988

[87] PCT Pub. No.: WO88/03583

PCT Pub. Date: May 19, 1988

[30] Foreign Application Priority Data

Nov. 11, 1986 [NL] Netherlands ..... 8602859

[51] Int. Cl.[4] ..... H63B 35/30

[52] U.S. Cl. ..... 114/27; 114/28; 114/29; 114/30; 114/32; 405/17; 405/223

[58] Field of Search ..... 414/137.7; 405/17, 18, 405/19, 223; 114/27-38; 383/79, 92; 298/24, 25, 27, 29

[56] References Cited

U.S. PATENT DOCUMENTS 1,495,428 5/1924 Neveling ..... 114/29
1,786,514 12/1930 Bickell ..... 114/27
3,456,824 7/1969 Smith ..... 414/137.7 X

FOREIGN PATENT DOCUMENTS 7629560 6/1985 Fed. Rep. of Germany .
7007626 5/1971 Netherlands .
7510447 3/1977 Netherlands .
212081 4/1968 U.S.S.R. ..... 114/32

*Primary Examiner*—Randolph A. Reese
*Assistant Examiner*—John Ricci
*Attorney, Agent, or Firm*—John P. Snyder

[57] ABSTRACT

A method for the forming and the deposition in a selected place of a bulk consisting substantially of loose or lightly cohesive material, such as sand or other ground material, for example for use as the core or base of a dam, quay, a bank reinforcement, a jetty or a breakwater, for filing holes or trenches in the bed of a waterway, or for the packaging and storage of contaminated material. The invention has for its purpose to carry out a method of the type in such manner that it can be performed very inexpensively and quickly, while nonetheless ensuring an excellent durability of the formed bulk, both in the short and the long term. This purpose is achieved according to the invention through a method of the kind stated in the heading, which is characterized in that a tank (1) is provided, a sheet or cloth (9) is laid in that tank, the loose or lightly cohesive material (17) is then poured onto the cloth or sheet until the tank is filled to a desired depth, after which the pouring is stopped, the projecting parts of the cloth or sheet are then jointed together, for instance by sewing, such that a substantially closed bag is formed enveloping the poured material, the tank is then positioned above the chosen place, and the bag filled with poured material is removed from the tank and deposited at the chosen place.

18 Claims, 7 Drawing Sheets

FIG. 2
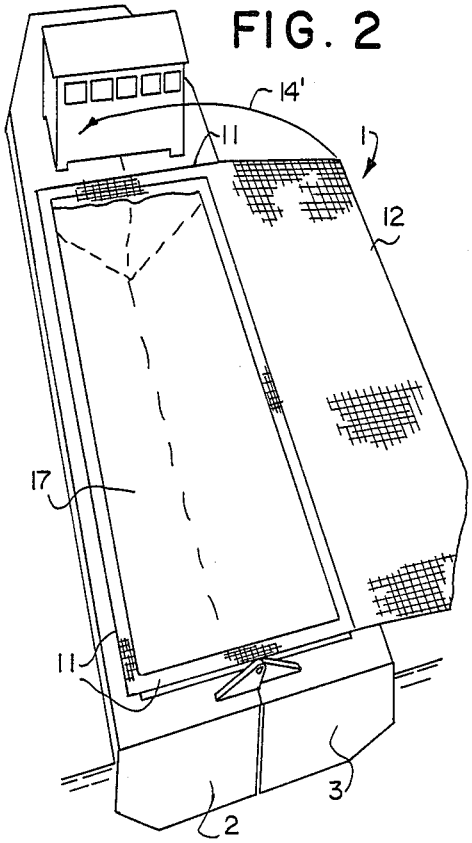
FIG. 3
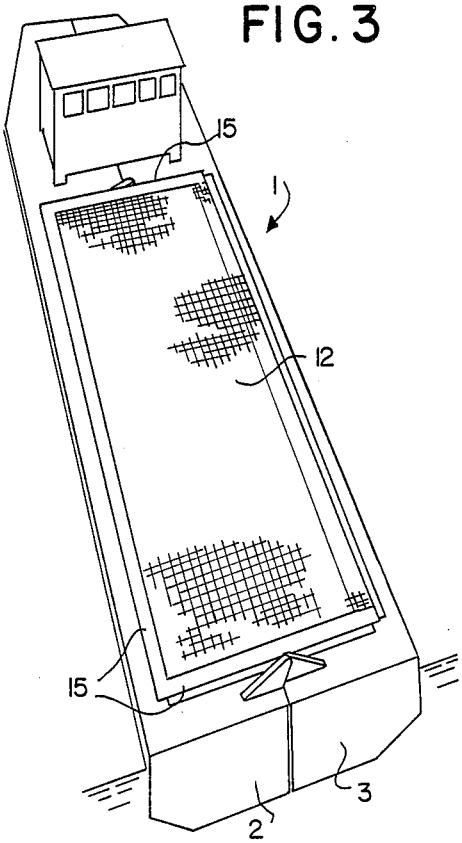
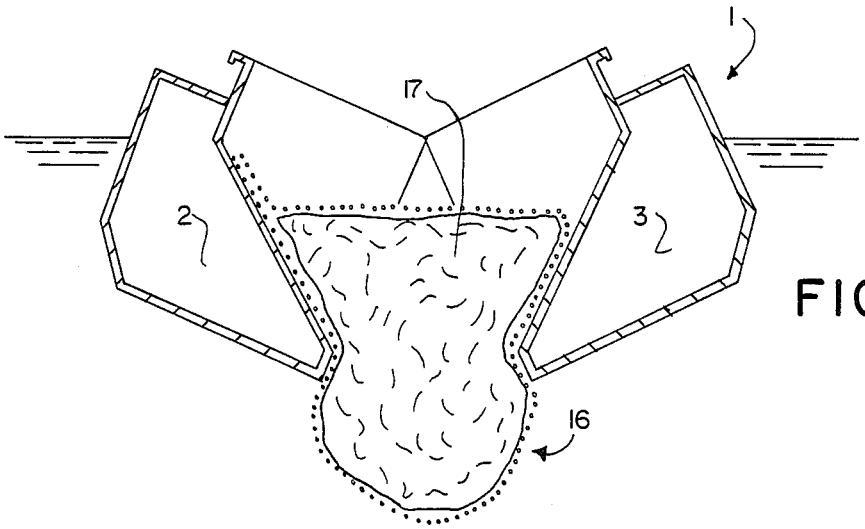
FIG. 5

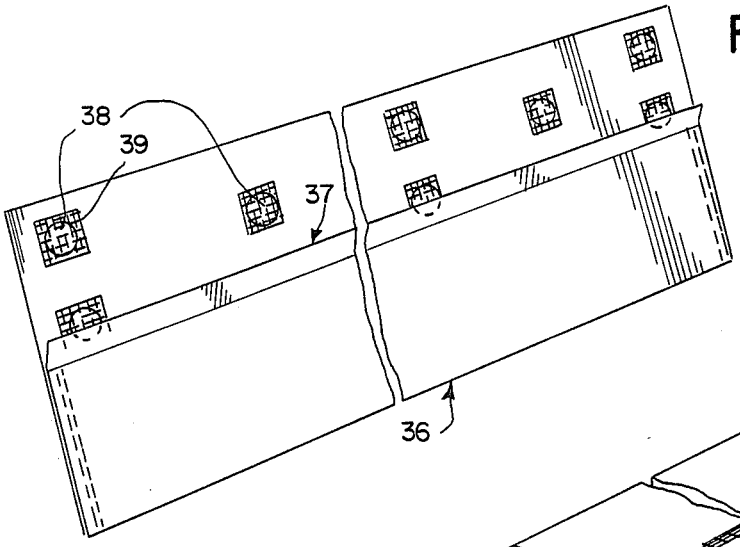
FIG. 10
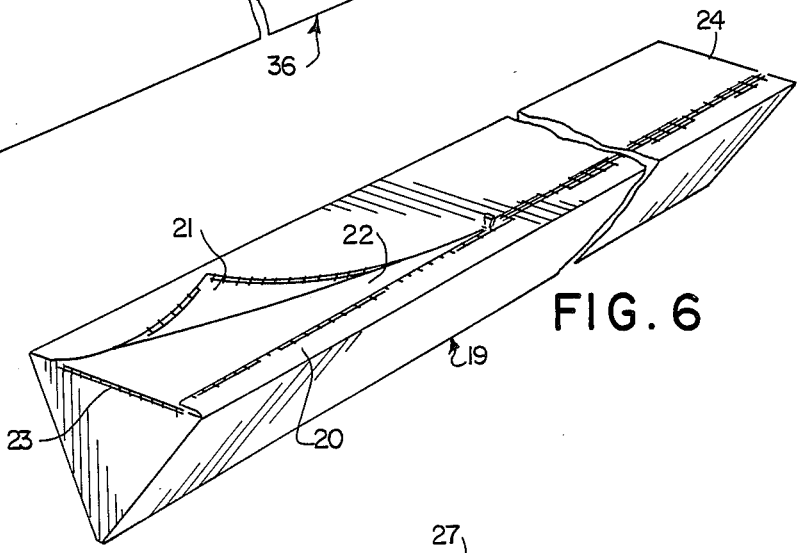
FIG. 6
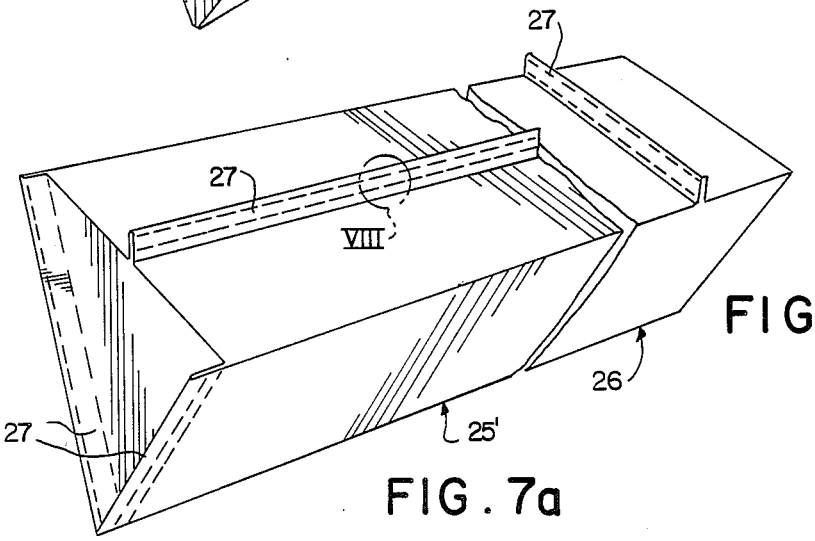
FIG. 7b
FIG. 7a

METHOD FOR THE FORMING AND THE DEPOSITION IN A SELECTED PLACE OF A BULK

The invention relates to a method for the forming and the deposition in a selected place of a bulk consisting substantially of loose or lightly cohesive material, such as sand or other ground material, for example for use as the core or base of a dam, a quay, a bank reinforcement, a jetty or a breakwater, for filling holes or trenches in the bed of a waterway, or for the packaging and storage of contaminated material.

A method of the kind is known in various embodiments.

The invention has for its purpose to carry out a method of the said type in such manner that it can be performed very inexpensively and quickly, while nonetheless ensuring an excellent durability of the formed bulk, both in the short and the long term. This purpose is achieved according to the invention through a method of the kind stated in the heading, which is characterized in that

- a tank is provided,
- a sheet or cloth is laid in that tank,
- the loose or lightly cohesive material is then poured onto that cloth or sheet until the tank is filled to a desired depth, after which the pouring is stopped,
- the projecting parts of the cloth or sheet are then joined together, for instance by sewing, such that a substantially closed bag is formed enveloping the poured material,
- the tank is then positioned above the chosen place, and
- the bag filled with poured material is removed from the tank and deposited at the chosen place.

A simple method according this type has the characteristic that

- a tank is provided of which the base is movable between two extreme positions, namely a closed and an open position,
- a cloth or sheet is then laid in the tank with closed base,
- the loose or lightly cohesive material is then poured onto that cloth or sheet until the tank is filled to the desired depth.
- the pouring is then stopped,
- the projecting parts of the cloth or sheet are then joined together, for example by sewing, such that a substantially closed bag is formed enveloping the poured material,
- the tank is then positioned above the chosen place,
- the base is there brought from its closed to its open position, whereby the bag containing the poured material is deposited at the chosen place.

In order to ensure that the risk of damage such as tearing as the result of impact stress on a filled bag is as far as possible prevented, that embodiment according to which the bag filled with poured material is gradually lowered into the chosen place is preferred.

This can be realized, for example, by a method showing the special feature that the tank, after it has been positioned above the chosen place, is made to settle into or to a small height above that place, and

- the base is brought from its closed into its open position, whereby the bag filled with poured material is deposited at the chosen place.

As an alternative, that method can serve according which the tank, after it has been positioned above the chosen place, is made to settle into or to a small height above that place, and is then made to tilt so that the bag filled with poured material is deposited into the chosen place.

In these last two mentioned embodiments, a tank is used which can be brought under control of hoisting means up to or nearly up to the chosen place. Once the chosen place has been reached, depositing of the filled bag at the chosen place is performed either by opening of the base or by tilting of the tank.

Another method that can be used has the characteristic that

- a tank is obtained of which the base is movable between two extreme positions, namely a closed and an open position,
- at least one supple, tensively strong supporting member, that is connected to a supply roll which can be unwound with a braking force, is laid in the tank,
- a cloth or sheet is laid over the supporting member in the tank with the base closed,
- the loose or lightly cohesive material is then poured onto the cloth or sheet in the tank, until the tank has been filled up to a desired depth, after which the pouring is stopped,
- the projecting parts of the cloth or sheet are then joined together, for example by sewing, in such manner that a substantially closed bag, enveloping the poured material, is formed,
- the tank is then brought to a position above the chosen place,
- the base is there brought from its closed into its open position, so that the bag filled with poured material rests upon the supporting member,
- by reducing the braking force, the supporting member is allowed to slacken, through which the filled bag descends, and
- after the chosen place has been reached the supporting member is removed, for example by interrupting it.

In this case, one does not cause the entire tank to descend into the chosen place and then cause the bag to be deposited in the intended place, but the tank is opened above the chosen place and the load is allowed to sink gradually. The supple, tensively strong supporting member may be embodied as a large number of tensively strong bands which are connected to the tank at one side and are coupled to a winch shaft on the other side. On the one hand, the winch can serve for winding up the tensively strong member, while on the other hand braking means should be present for the controlled sinking of the load. The end of the tensively strong member remote from the winch shaft can be connected detachably to the other side of the tank, for example by hooks or the like.

In particular, a floatable tank can be used.

In this case the tank can form part of a watergoing vessel. The vessel comprises a tank portion, which comprises two sloping, pivotably mounted flat walls, which when closed can cooperate in the manner of a bunker and which can be pivoted out of that closed position into an open position. The bag, previously filled with bulk material, which may be for example scraped from the bed of the waterway concerned, and then closed, is dumped by the opening of the base. The bulk material can also consist of polluted sand or of sludge. Using the method according the invention, such material can be stored in basins or the like. Thus a compartmentalizing of the polluted material can take place, which in the case of certain materials can provide a solution to the environmental problems.

In order to ensure the easiest possible dumping of a filled and closed bag on opening the base of the tank, it can be advantageous to first lay a slide mat on the base of the tank. This mat thus lies on the base of the tank under the cloth or sheet.

A method can be advantageously applied according to which a prefabricated container, of which the form is suited to the form of the tank in its closed state, is used as the cloth or sheet.

Preferably, a sheet or cloth is chosen of which the permeability is suited to the loose or lightly cohesive material to be accommodated therein. In cases where it is desired to dump the filled and closed bag in water, a material with a desired permeability to water may be chosen. Here may be considered a woven fabric, of for instance polyethylene monfilament warp with a weft consisting of a multifilament or tape yarn, or alternatively of a polypropylene multifilament for both warp and weft.

The invention further concerns a sheet or cloth that is suitable for use in conjunction with the above-described methods.

The invention also concerns a prefabricated container for use in the above methods. In particular such a container can have a shape that is suited to the shape of the tank to be used, in its closed state.

A preferred embodiment of such a prefabricated container is characterized by at least one portion with an increased permeability, in particular for the passing through of air. Such a portion with increased permeability can be regarded as a window or valve, whereby in particular the expression of trapped air is facilitated. This can be important for a stable positioning of a dumped container under water.

In the situation where the force with which the container falls on the bed is so great that the container fails, use can be made of a variant which is provided with at least one expansion gusset, in part breakable under transversely applied tensile force. Such a gusset initially takes up the forces in the cloth or sheet, which result from deformation of the container under influence of the severe shock forces in the relatively heavy filling material. On partial failure of the gusset, there results an extra margin in the cloth length, whereby the effective girth of the container is enlarged and the forces are reduced to less damaging proportions. Thus such an expansion gusset may be regarded as a safety measure.

The projecting parts of a filled container can, as already stated, be joined together by for instance sewing. Preferably, however, the container is itself already equipped with joining means for so joining the edges of the projecting parts of the filled container together, that the container is closed thereby. For example the joining means can comprise at least one zip fastener. In a simpler embodiment, the joining means can be embodied as rows of holes present in oppositely situated edges, for the lashing together of those edges by means of a rope.

In the case where use is made of a cloth or sheet that is impermeable to water, any accumulated air present in the bag could be eliminated through air valves. For this purpose use could also be made of an extra water layer above the bag in the tank, to drive out the superfluous air under force. The extra water involved flows away during the dumping of the bag.

The invention also relates to a tank, that is prepared and clearly intended for use in conjunction with a method according the invention, as specified above.

Such a tank can be for instance characterized by a base that is movable between two extreme positions, namely a closed and an open position.

The invention also extends to a frame for the carrying of a tank of the type already discussed. This frame can be characterized by means for the supporting and controlled lowering of a filled bag that may be present in the tank.

Such a frame may optionally be floatably embodied.

The invention will now be elucidated by reference to the drawing of an embodiment. In the drawing:

FIG. 2 shows the vessel according to FIG. 1, in which the tank has been filled with bulk material;

FIG. 3 shows the vessel according to FIG. 2, in which the sheet has been closed to form a bag;

FIG. 5 shows the aspect according to FIG. 4 in which the base is opened for the deposition of the bag filled with bulk material;

FIG. 6 shows a schematic perspective view of a prefabricated container, with a zip fastener;

Figure 8:
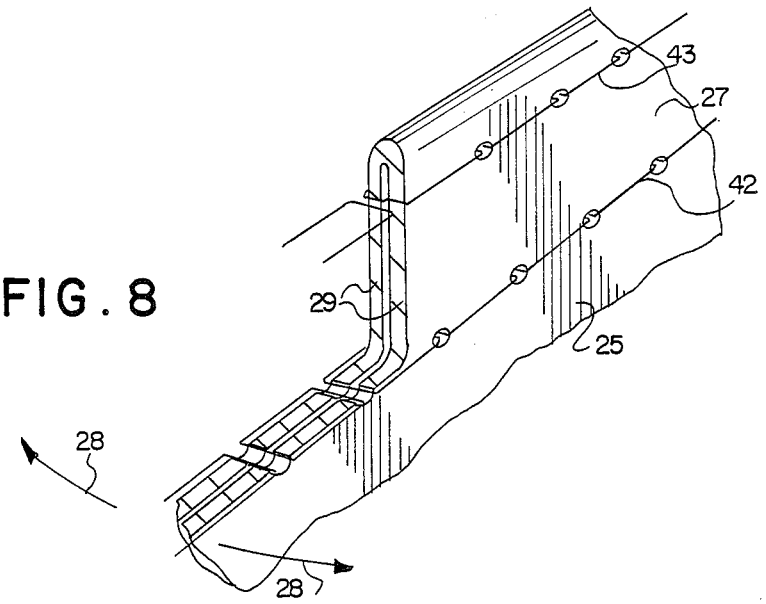

FIGS. *7a* and *7b* show, drawn in complementary form, variants with a number of expansion gussets;

FIG. 8 shows a partly cut-away perspective view of detail VIII of FIG. *7a;*

Figure 9:
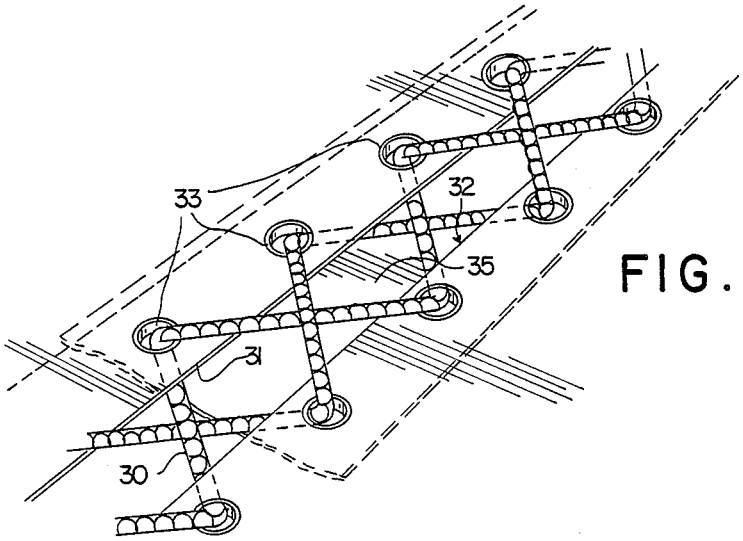
Figure 11:
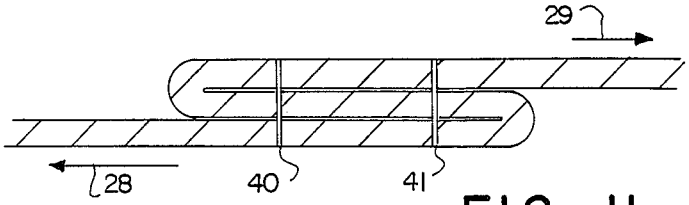
Figure 12:
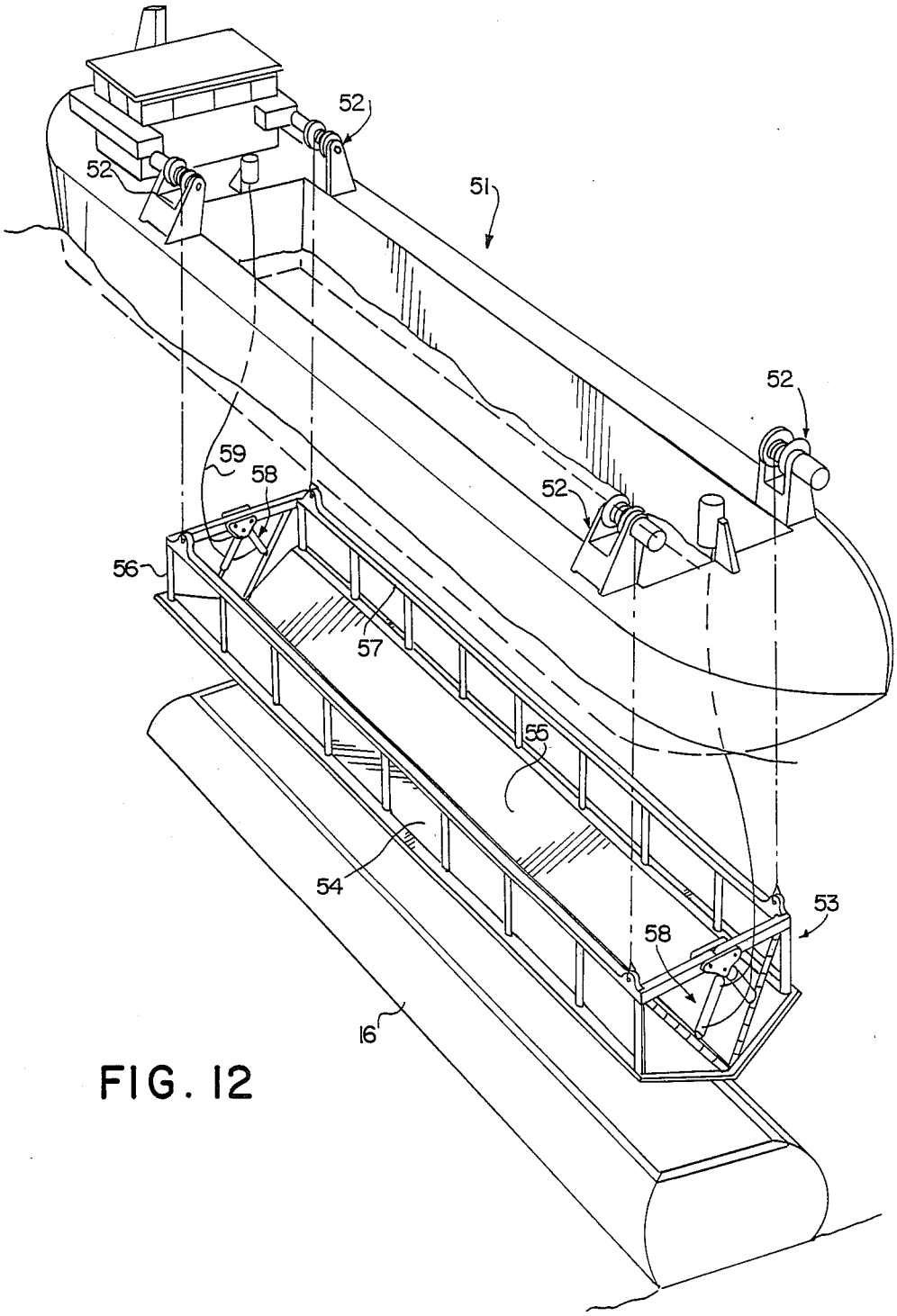
Figure 13:
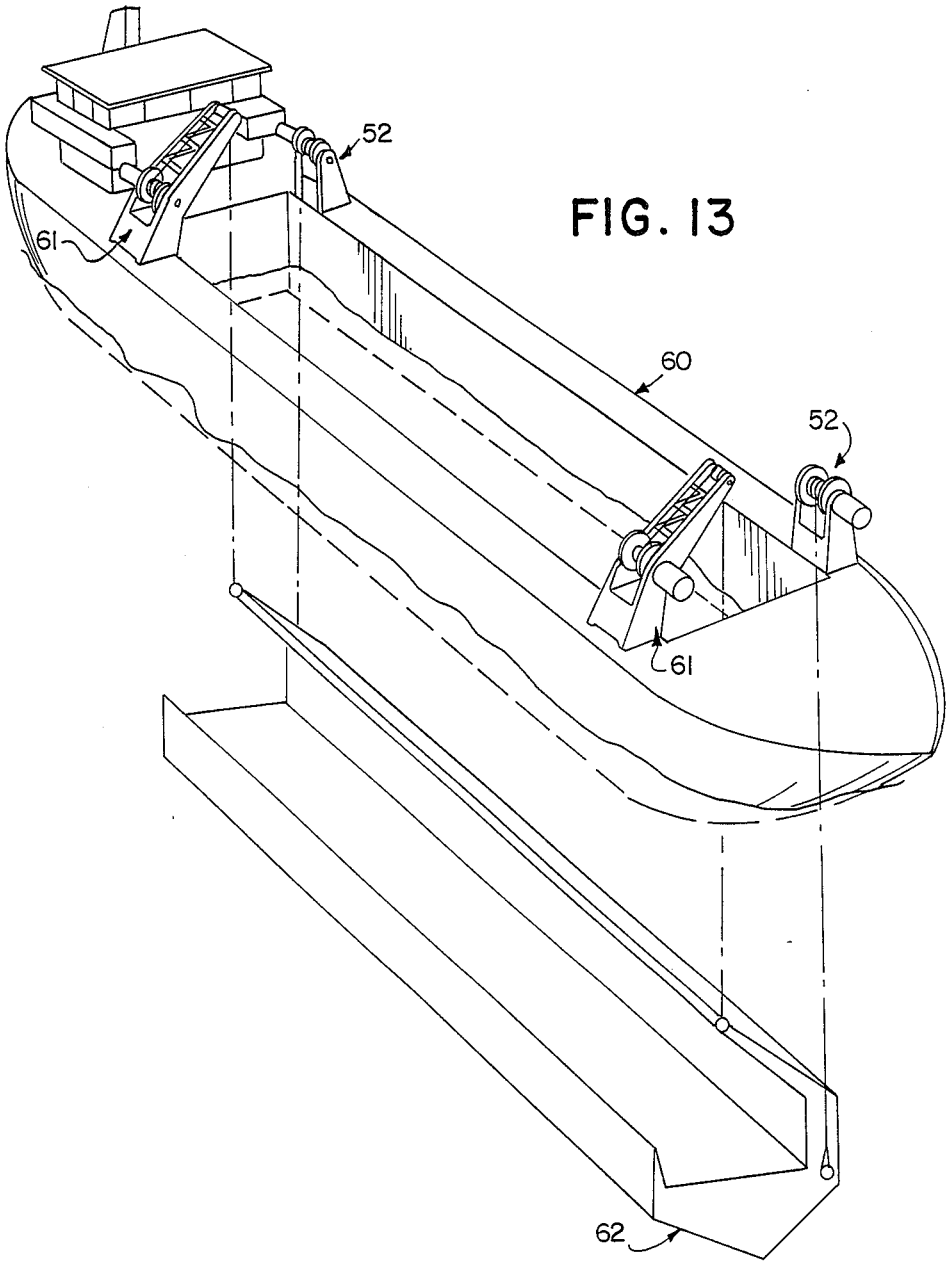

FIG. 9 shows a lashing connection for the closing of a container;

FIG. 10 shows a perspective view of a prefabricated container in a simpler embodiment;

FIG. 11 shows a cross-section through a flat expansion gusset;

FIG. 12 shows a watergoing vessel with a sinkable split tank;

FIG. 13 shows a watergoing vessel with a sinkable tilt tank; and

Figure 14:
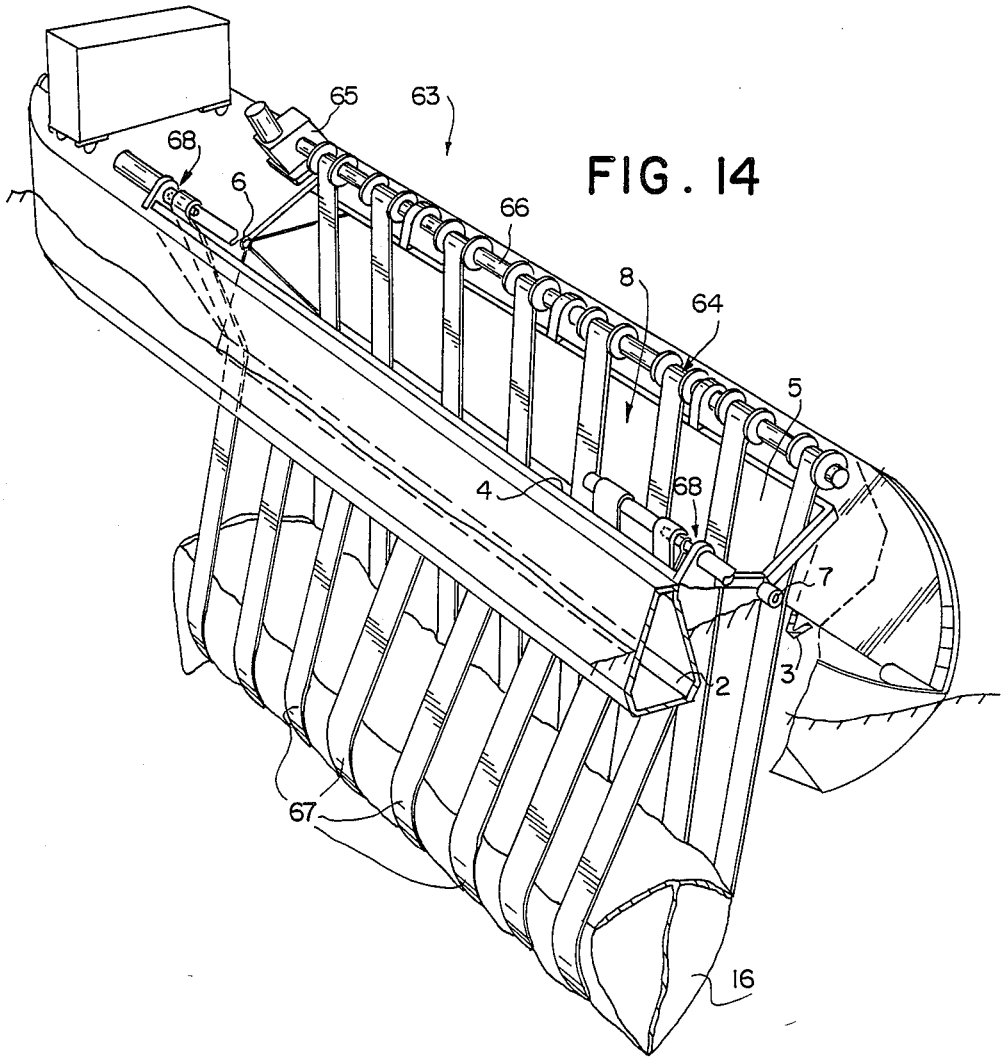

FIG. 14 shows a watergoing vessel embodied as a split tank with winch means for the lowering of a filled bag.

Figure 1:
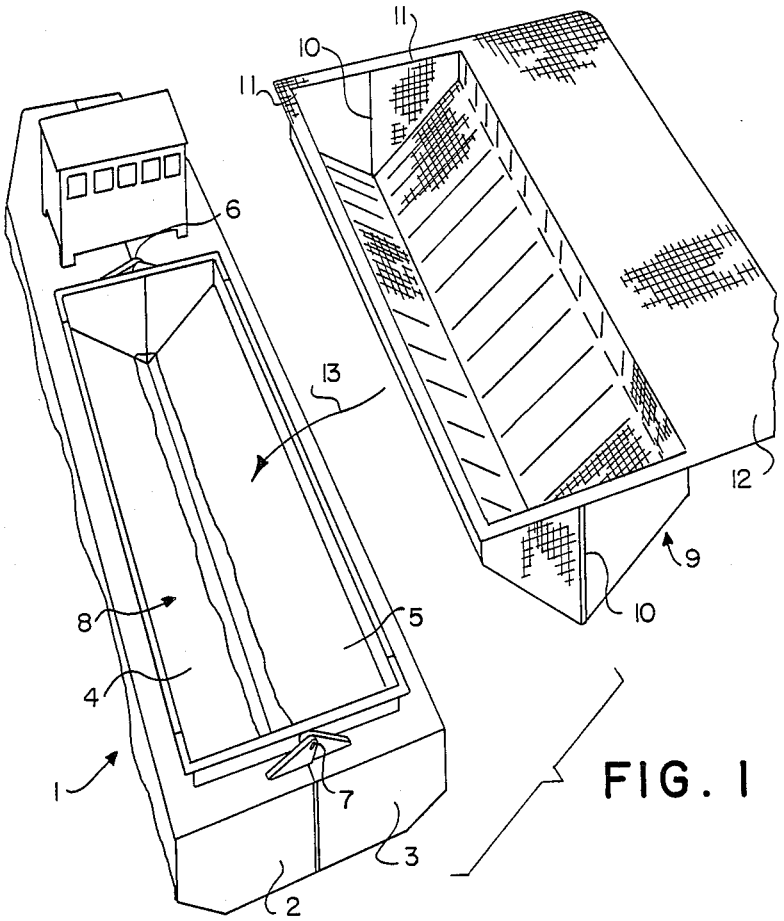
FIG. 1 shows a perspective view of a watergoing vessel with a tank which can be opened and closed, and a sheet to be placed therein.

FIG. 1 shows a watergoing vessel 1 that comprises two floatable elongated parts 2,3, arranged pivotably with respect to one another. The inner walls of these parts 2,3 which are indicated by numerals 4,5 form together a V-shape in cross-section, as can be seen particularly clearly in FIG. 4. In the closed situation according to FIGS. 1 to 4, walls 4,5 bound a closed tank. This is the one extreme situation. In another extreme situation, walls 4,5 have been moved apart, as illustrated in FIG. 5. This situation will be described hereafter.

The floatable parts 2,3 are pivotably connected together through hinges 6,7. Means for opening and closing the tank bounded by walls 4,5, are not depicted. These can be generally known, in particular hydraulic, means.

As indicated schematically in FIG. 1, a sheet 9, represented in a strongly idealized way in FIG. 1, can be placed into the tank 8 bounded by walls 4,5. Sheet 9 is in this embodiment already formed into a prefabricated container, whose form is suited to the shape of tank 8, by means of sewn seams 10. A relatively small flap 11 projects a short way from three sides of the sheet, while a large flap 12 extends from one side of the sheet.

The manner in which sheet 9 is placed into the tank will be evident. This is indicated by an arrow 13.

In the situation according to FIG. 2, sheet 9 has been placed in tank 8 and completely filled with bulk material. The way in which this has taken place is not depicted. To this end, for example, sand, spoil or other ground material can be dredged from the waterway and poured into tank 8 onto sheet 9.

After the desired filling depth has been reached, flap 12 is folded over following arrow 14 to pass over small flaps 11.

FIG. 3 shows that the overlapping zones, which are all indicated by reference number 15, are sewn together so that a robust filled bag 16 is obtained.

Figure 4:
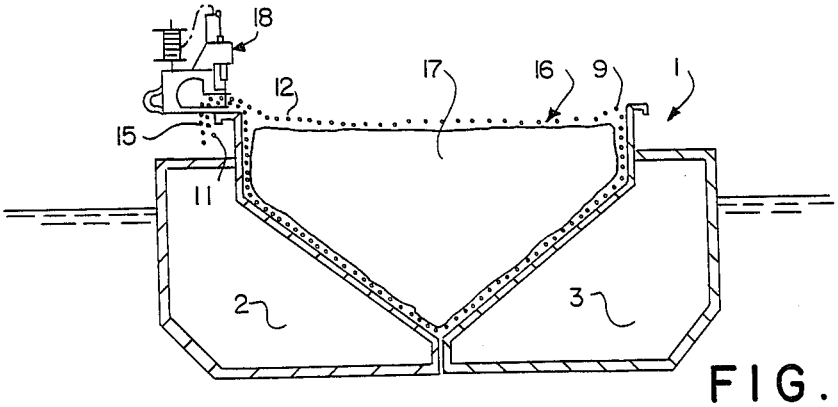
FIG. 4 shows a transverse section through the vessel according to the preceding figures, in which is indicated the way in which the bag is sewn up.

FIG. 4 shows, for the sake of clarity, the configuration of FIG. 3 again in cross-section. It is apparent that the bulk material 17 has filled the entire bag 16. A schematically indicated sewing machine 18 shows how the large flap 12 is sewn to the small flaps 11, which if necessary can be fastened to the edge of the tank to facilitate the execution.

When the working with sewing machine 18 has been completed, the filled bag 16 is ready to be deposited at the desired place. To that end the vessel 1 can be brought to a position above the desired place (an activity which can take place at the same time as the sewing), and after the place concerned has been reached the pivotable parts 2,3 can be moved apart from each other in the manner shown in FIG. 5 by the unshown, for instance hydraulic, means, whereby a funnel open at the bottom is formed, through which the filled bag 16 can be passed and deposited on the bed of the waterway.

FIG. 6 shows a perspective view of a prefabricated container 19, of which the form, analogous to that shown in FIG. 1, is suited to the shape of a tank to be used. At the top, at the one side of the container 19, a narrow longitudinal flap 20 extends, while on the other side a broad longitudinal flap 21 is present. This broad longitudinal flap 21 can be joined by means of zip fasteners 22, 23, 24 to the narrow longitudinal flap, and to the short sides of container 19, respectively.

FIGS. *7a* and *7b* show, respectively, containers 25 and 26, of which the general shape corresponds to container 19 according to FIG. 6. Container 25 according to FIG. *7a* is also provided with expansion gussets, generally indicated by 27, which will be further discussed by reference to FIG. 8. Container 25 according to FIG. *7a* is provided with expansion gussets at its end surfaces, and an expansion gusset 27 extending in the longitudinal direction of container 25 over an upper surface thereof. Container 26 according to FIG. *7b* has an expansion gusset 27 extending in the transverse direction on the upper surface of container 26.

As already explained, the expansion gussets serve to accommodate forces which can arise when a deposited container comes to rest on the ground with a shock. It will be clear without further comment that the fabric of the container can thereby be subjected to a large tensile force.

FIG. 8 shows with arrows 28 the direction of those tensile forces. Expansion gusset 27, which consists of two cloth parts 29 projecting from the principal surface of the cloth and laid over each other, is sewn through in two places as indicated by reference numbers 29 and 30. On exertion of tensile forces 28, sewn seam 42 will be loaded first. If the forces are so great that this seam fails, then there comes about an extra margin or length in the cloth of container 25 in the direction of tensile force 28, so that the forces are reduced. Should this not be sufficient, sewn seam 43 can also still fail. Practice indicates that through this double safety measure there is no longer any danger that a deposited container will fail.

FIG. 9 shows a lashed connection 30. In opposing edges 31, 32, rows of holes 33 are present for the lashing together of those edges by means of ropes 34. To ensure a satisfactory seal at the place of lashed connection 30, there extends a flap 35 from edge 31, under the holes 33. This flap 35 is first laid on the bulk material, after which edge 32 is placed thereover; finally ropes 34 are applied to fix edges 31, 32 relative to each other.

FIG. 10 shows a simpler container 36. This shows a less elegant adaptation of the form to a tank than the containers described above. However, container 36 according to FIG. 10 has the advantage that it can be made more cheaply but can nonetheless be of a high quality. In contrast to the previously described containers, container 36 does not have more or less triangular end surfaces for optimal suiting of the form to a tank. It is provided with a more or less slit-like opening 37, through which the material can be poured into container 36. At the place of this slit 37, the previously described joining means can be present in the form of a zip fastener or rows of holes for the closing of container 36.

In this embodiment air valves 38 are also shown. These air valves 38 consist of holes covered by relatively coarse-woven material 39. The sizes, positions and numbers of these air valves 38 can be chosen according to the wishes of the user. Moreover, attention is drawn to the fact that the previously described containers can also be equipped with similar air valves.

FIG. 11, finally, shows an expansion gusset 40. Unlike gusset 27, shown in particular in FIG. 8, gusset 40 is embodied in a flat form, which makes the gusset less vulnerable. Three layers of the material of the container concerned are laid one upon the other, and are joined together with two stitched seams 40, 41, further entirely analogously to the embodiment according to FIG. 8.

The operation of the embodiment of FIG. 8 applies, mutatis mutandis, to that of FIG. 11: tensile force 28 can break stitched seams 40, 41, whereby a margin in the length of the container fabric results and the risk of failure is at least considerably reduced.

FIG. 12 shows a watergoing vessel 51 that is embodied as a floatable frame with winching means 52. These winching means 52 support a frame 53 with base parts 54. Frame 53 comprises two parts 56, 57, pivotable with respect to one another, supporting the respective base parts 54 and 55, which can be moved towards and away from each other by means of cylinders 58. Cylinders 58 are coupled through hoses 59 to unshown powering and control means.

Using vessel 51, the method according to the invention takes place as follows. First, sheet 9 is placed on base parts 54, 55 of frame 53, in the situation in which frame 53 is located in vessel 51. The bulk material is poured onto sheet 9, and when the desired filling depth has been achieved a filled bag is made ready entirely according to the manner shown in FIGS. 1–4. After this has taken place, vessel 51 is navigated to the chosen place and frame 53 is lowered by appropriate operation of the winch means 52 onto the bed of the waterway at the desired position. Through operation of cylinders 58, base parts 54, 55 are moved apart, whereby bag 16 is deposited at the desired place.

FIG. 13 shows a variant of the embodiment according to FIG. 12. A vessel 60 is embodied in practically the same form as vessel 51 according to FIG. 12. However, in this embodiment the vessel 60 comprises, besides winching means 52, winching means 61 placed on one side, which extend approximately centrally above a tilting tank 62. After the placing of a sheet and the filling of a container with bulk material in the same way as described in connection with FIG. 12, tilting tank 62 is brought to the chosen place by means of winching means 61. Through the empowering of winching means 52, tank 62 is tilted, whereby the container (not shown in FIG. 13) is brought into its place or the desired place.

Finally, FIG. 14 shows a vessel 63 which possesses roughly the same construction as vessel 1 according to FIGS. 1, 2, 3, 4 and 5. Vessel 63 is however equipped with winching means 64, comprising winching shaft 66 driven by a motor 65 through a reduction gearbox. With this winching shaft cooperate tensively strong supple bands 67, which are detachably coupled at the other end to vessel 63. The coupling means are indicated by reference number 68.

Before placing sheet 9 in tank 8, bands 67 are placed therein. The bulk material is then poured onto sheet 9, after which, after vessel 63 has arrived above the chosen place, parts 2, 3 are moved apart and filled bag 16 comes to rest on bands 67. Winching means 64 are then activated by empowerment of motor 65, whereby a steady sinking of container 16 takes place. After container 16 has reached the bed of the waterway, bands 67 are released by actuation of the coupling means, whereafter they can be wound up onto winch shaft 66 through a corresponding activation of winching means 64. After the closing of tank 8, the appropriate ends of bands 67 can be reconnected to the coupling means 68, after which the cycle can be repeated.

Attention is drawn to the fact that the sinking of a tank according to the embodiment of FIGS. 12 and 13 can if desired take place by use of guiding means, such as guide rails coupled or capable of being coupled to the ship.

Attention is also drawn to the fact that the invention is not restricted to the use of a floatable tank, corresponding to the above described example. Tanks that are transportable over land also fall within the scope of the invention.

I claim:

1. A method for depositing in a selected location a bulk material consisting substantially of loose or lightly cohesive material such as sand or other ground material comprising, providing a tank, placing a sheet of material in said tank, placing loose or lightly cohesive material on said sheet until the tank is filled to a desired depth, connecting portions of said sheet to one another to form a substantially closed envelope around said bulk material, positioning the tank substantially above the location where the bulk material is to be deposited, and then removing the envelope from said tank and depositing the envelope with the bulk material therein at said location.

2. A method as defined in claim 1 wherein the tank includes movable portions which can be moved between open and closed positions, and including the steps of initially moving said portions to closed position before placing the sheet of material in said tank, and wherein the step of removing the envelope from said tank includes moving said movable portions to open position.

3. A method as defined in claim 2 wherein after the tank is positioned substantially above the location where the material is to be deposited, the additional step of lowering the tank to a position adjacent said location prior to moving said movable portions to open position.

4. A method as defined in claim 1 wherein the step of depositing the envelope is carried out gradually.

5. A method as defined in claim 1 wherein after the tank is positioned substantially above the location where the material is to be deposited, the additional steps of lowering the tank to a position adjacent said location, and then tilting said tank to remove the envelope from said tank.

6. The method as defined in claim 1 including the step of first placing a slide mat in said tank, and then placing said sheet of material on said slide mat.

7. A method for depositing in a selected location a bulk material consisting substantially of loose or lightly cohesive material such as sand or other ground material comprising, providing a tank having movable portions movable between open and closed positions, initially moving said portions to closed position, providing a flexible supporting means and placing said supporting means in said tank, placing a sheet of material on said supporting means in said tank, placing loose or lightly cohesive material on said sheet until the tank is filled to a desired depth, connecting portions of said sheet to one another to form a substantially closed envelope around said bulk material, positioning the tank substantially above the location where the bulk material is to be deposited, moving said movable portions to open position and adjusting the position of one end of said supporting means to remove the envelope from said tank and lower the envelope to said location, and depositing the envelope with the bulk material therein at said location.

8. A method as defined in claim 7 wherein the other end of said supporting means is detachably supported by said tank, and said step of depositing the envelope comprises detaching said other end from the tank to deposit the envelope.

9. Apparatus for depositing in a selected location a bulk material consisting substantially of loose or lightly cohesive material such as sand or other ground material comprising in combination, an envelope containing bulk material therein, said envelope including a sheet of material, connecting means for connecting portions of said sheet to one another to form a substantially closed envelope surrounding the bulk material therein, a tank supporting said envelope, means for moving said tank into position substantially above a location where bulk material is to be deposited, said tank including means for removing and depositing said envelope from said tank, whereby said envelope with the bulk material therein can be deposited at said location.

10. Apparatus as defined in claim 9 wherein said tank is buoyant so that it floats in water.

11. Apparatus as defined in claim 9 wherein said tank has a certain internal configuration, said envelope comprising a prefabricated container having an outer configuration similar to said internal configuration.

12. Apparatus as defined in claim 9 wherein said sheet of material has a permeability which retains the loose or lightly cohesive material therein.

13. Apparatus as defined in claim 9 wherein at least one portion of said envelope has a greater permeability than other portions thereof to permit the passage of air therethrough.

14. Apparatus as defined in claim 9 wherein said sheet includes at least one expansion gusset, and means to permit expansion of said gusset under tensile forces applied thereto.

15. Apparatus as defined in claim 9 wherein said connecting means comprises zipper fastener means.

16. Apparatus as defined in claim 9 wherein said connecting means comprises a plurality of holes in spaced portions of said sheet, and lashing means extending through said holes for lashing said portions to one another.

17. Apparatus as defined in claim 9 wherein said means for removing and depositing said envelope comprises at least two movable portions movable relative to one another between open and closed portions.

18. Apparatus as defined in claim 17 wherein said means for removing and depositing said envelope includes means for supporting and controlling lowering of an envelope.

* * * * *